US007168380B2

(12) United States Patent
Canniffe et al.

(10) Patent No.: US 7,168,380 B2
(45) Date of Patent: Jan. 30, 2007

(54) BOAT LIFT SYSTEMS

(75) Inventors: Mathew Joseph Canniffe, Burleigh Waters (AU); Michael John Hogan, Isle of Capri (AU); Emmanuel Hillel Szumer, Buderim (AU)

(73) Assignee: Hotsun Holdings Pty Ltd, Nerang (AU)

( * ) Notice: Subject to any disclaimer, the term of this patent is extended or adjusted under 35 U.S.C. 154(b) by 0 days.

(21) Appl. No.: 11/314,164

(22) Filed: Dec. 22, 2005

(65) Prior Publication Data

US 2006/0156964 A1 Jul. 20, 2006

(30) Foreign Application Priority Data

Dec. 24, 2004 (AU) ..... 2004907343

(51) Int. Cl.
*B63C 7/00* (2006.01)
*B63C 3/06* (2006.01)

(52) U.S. Cl. ..... 114/49; 405/3

(58) Field of Classification Search ..... 114/44, 114/46, 49, 50, 52, 53; 405/3
See application file for complete search history.

(56) References Cited

U.S. PATENT DOCUMENTS

| | | | | |
|---|---|---|---|---|
| 2,325,607 | A * | 7/1943 | Harris | 114/46 |
| 4,479,450 | A * | 10/1984 | Lundberg | 114/46 |
| 5,002,000 | A | 3/1991 | Rutter | |
| 5,281,055 | A * | 1/1994 | Neitzke et al. | 405/219 |
| 5,947,049 | A | 9/1999 | Elson | |
| 6,006,687 | A * | 12/1999 | Hillman et al. | 114/46 |
| 6,138,599 | A * | 10/2000 | Elson | 114/263 |
| 6,752,096 | B2 | 6/2004 | Elson et al. | |
| 6,752,097 | B1 | 6/2004 | Elson et al. | |
| 2004/0089212 | A1 | 5/2004 | Vinnik | |
| 2004/0184882 | A1 | 9/2004 | Cosgrove | |

FOREIGN PATENT DOCUMENTS

| | | | |
|---|---|---|---|
| DE | 19806798 | A1 | 3/2000 |
| EP | 1431175 | A1 | 6/2004 |

* cited by examiner

*Primary Examiner*—Jesús D. Sotelo
(74) *Attorney, Agent, or Firm*—Dennison, Schultz & MacDonald

(57) ABSTRACT

A module for a boat lift that combines features of both pontoon type and modular type constructions. Each module includes upper and lower pontoons, and can be connected in-line to form one side of a lift, and in parallel to form opposed sides of a lift. A typical lift includes four modules connected with two on each side.

10 Claims, 9 Drawing Sheets

BOAT LIFT SYSTEMS

BACKGROUND TO THE INVENTION

This invention relates to boat lift systems and in particular but not only to a modular lift system for small boats.

Boat lifts are manufactured in a variety of forms, including pontoon types which are raised and lowered by buoyancy controls, and modular types which are formed as rafts of interconnected flotation compartments onto which the boats are usually winched. The lifting operation of a pontoon type is usually preferred but they are often less convenient than modular types in terms of transport and assembly, and for accommodating boats of different sizes. Pontoon types may also be inoperable while relatively small parts are repaired. A range of modular boat lifts are known, such as those described in U.S. Pat. No. 5,281,055; U.S. Pat. No. 6,138,599; and U.S. Pat. No. 6,006,687.

SUMMARY OF THE INVENTION

It is an object of the invention to provide a boat lift system which combines aspects of both pontoon and modular type lifts, or at least to provide an alternative to existing lift systems.

In one aspect the invention may be said to reside in a flotation module for a boat lift, including: a lower pontoon having a port for entry and exit of water when decreasing or increasing buoyancy of the lift, an upper pontoon connected to the lower pontoon and having a port for entry or exit of air when increasing or decreasing buoyancy of the lift, end coupling means for coupling in-line to a further module when forming a common side of the lift, and side coupling means for coupling in parallel to a further module when forming opposing sides of the lift.

Preferably the port in the upper pontoon includes a pipe inside the module and extending downwards toward the lower pontoon. The end of the pipe may be used to determine the maximum water line and minimum buoyancy of the module. The port in the lower pontoon may include a pipe outside the module and having a free end which can be raised or lowered in relation to the waterline.

Preferably the lower and upper pontoons are elongate chambers connected together by a pair of struts. The pontoons and struts may be moulded together as an integral structure.

Preferably the end coupling means includes at least one aperture to receive a connector device at the end of each pontoon. Preferably the side coupling means includes at least one aperture to receive a connector device in the side of the lower pontoon.

The invention also resides in a boat lift formed from a plurality of modules as described above. An even number of the modules, typically four or six, is generally required. The individual modules may be transported and then assembled, and replaced if required, relatively easily compared to the fully assembled system.

Preferably the boat lift includes a pneumatic control system and one or more inclinometers by which the orientation of the lift may be stabilised. Preferably the orientation is controlled while during raising and lowering of a boat in the water, so that the stem of the boat is lower than the bow.

LIST OF FIGURES

Preferred embodiments of the invention will be described with reference to the accompanying drawings, of which:

Figure 1:
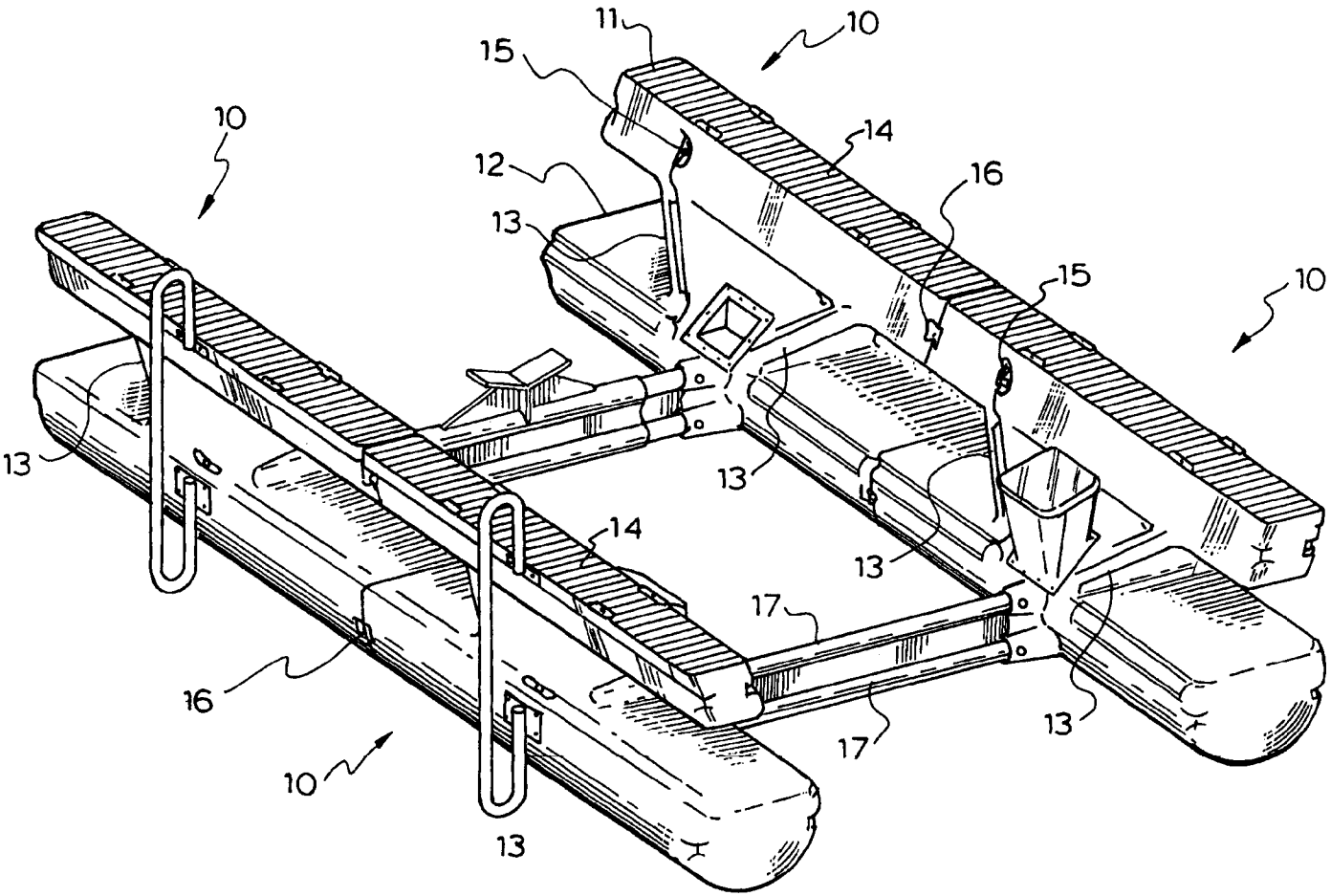
FIG. 1 shows a boat lift formed by four modules.
Figure 3:
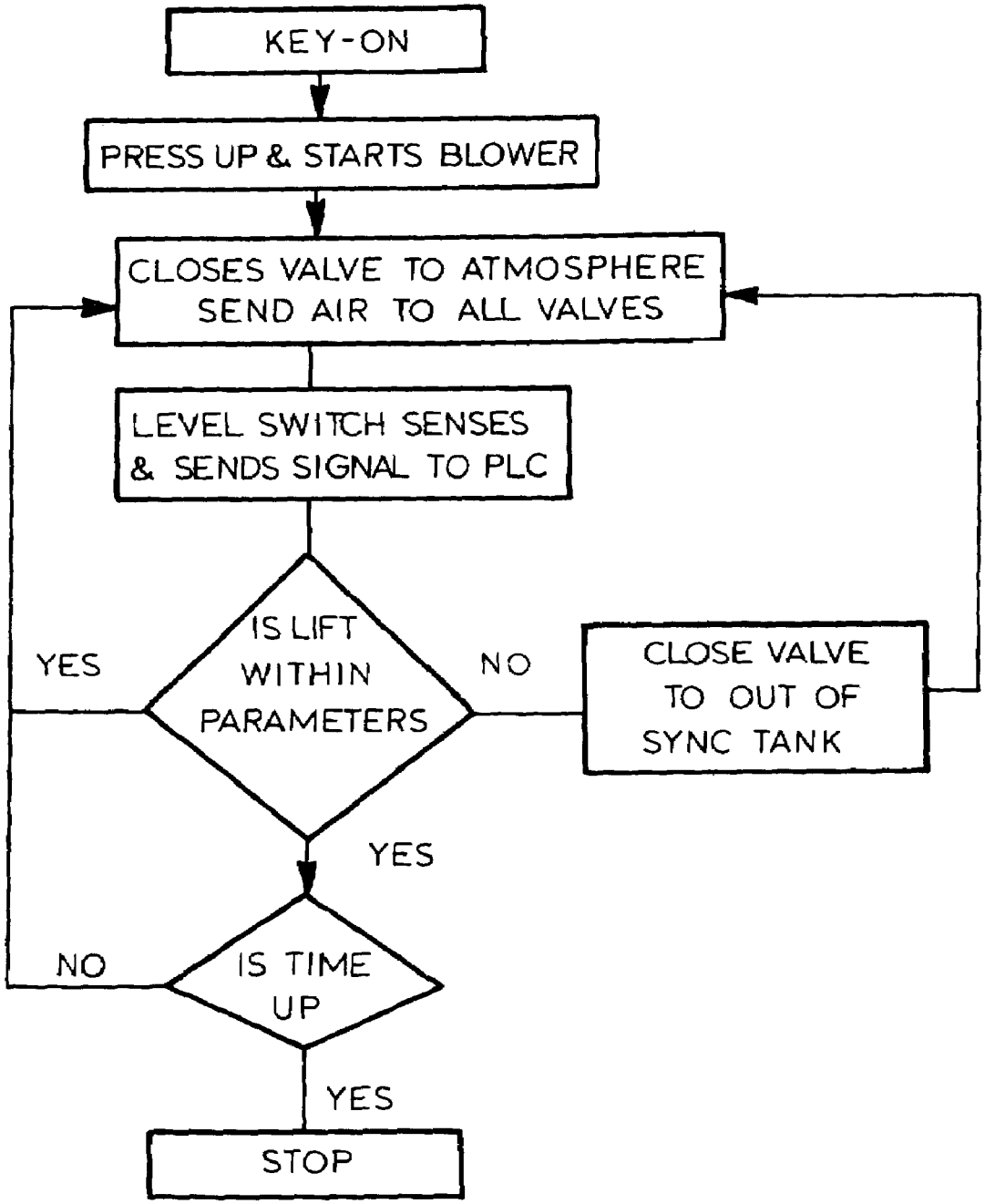
Figure 4A:
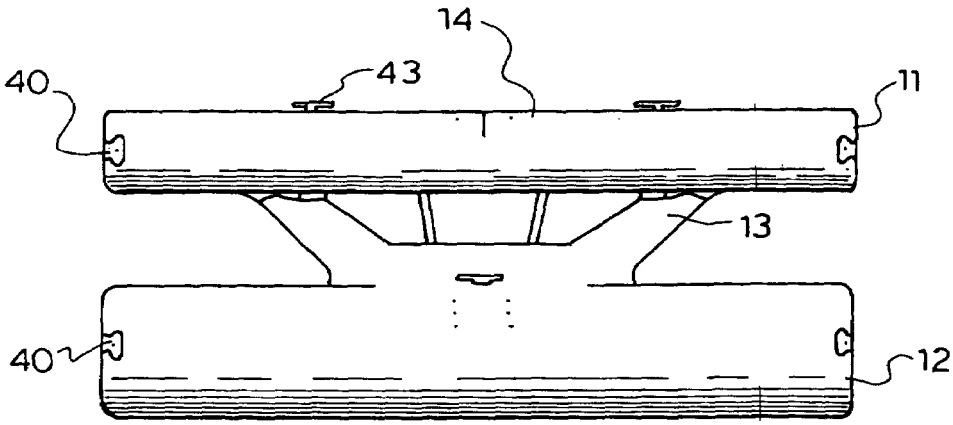
Figure 4B:
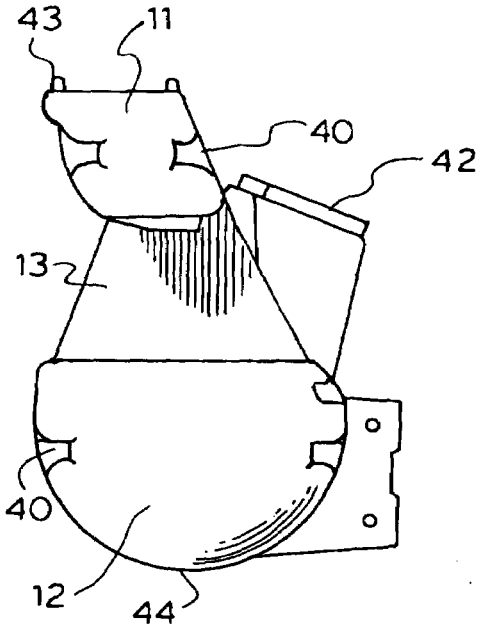
Figure 4C:
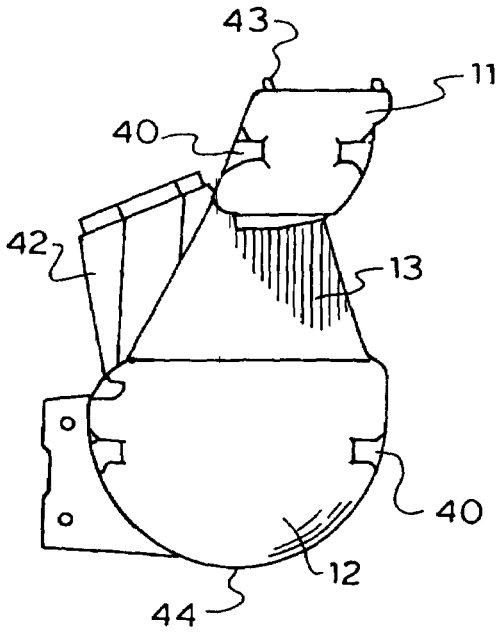
Figure 5A:
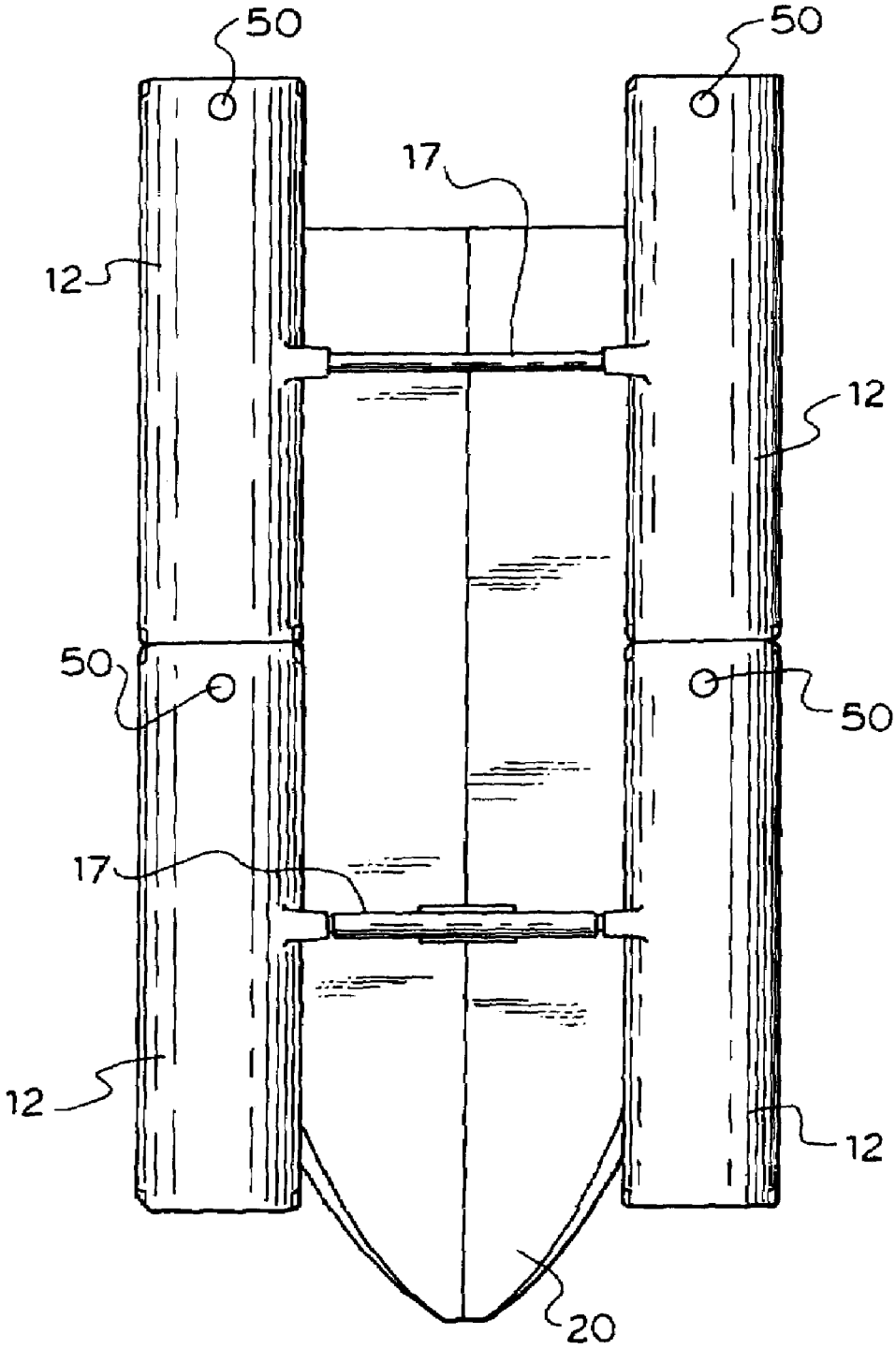

FIG. 3 outlines the operation of an automated lift controller,

FIGS. 4*a, b, c* are side and end views of a module in FIG. 1,

FIGS. 5*a, b, c, d* show aspects of an air pump system in the lift, and

Figure 6A:
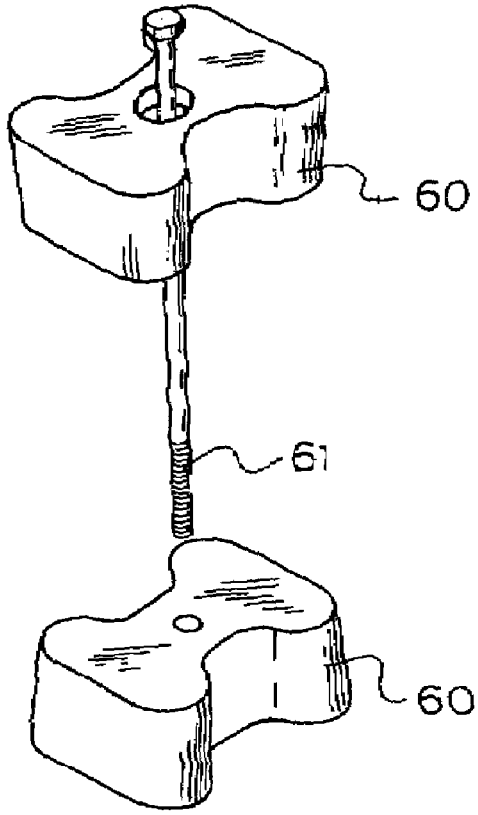
Figure 6B:
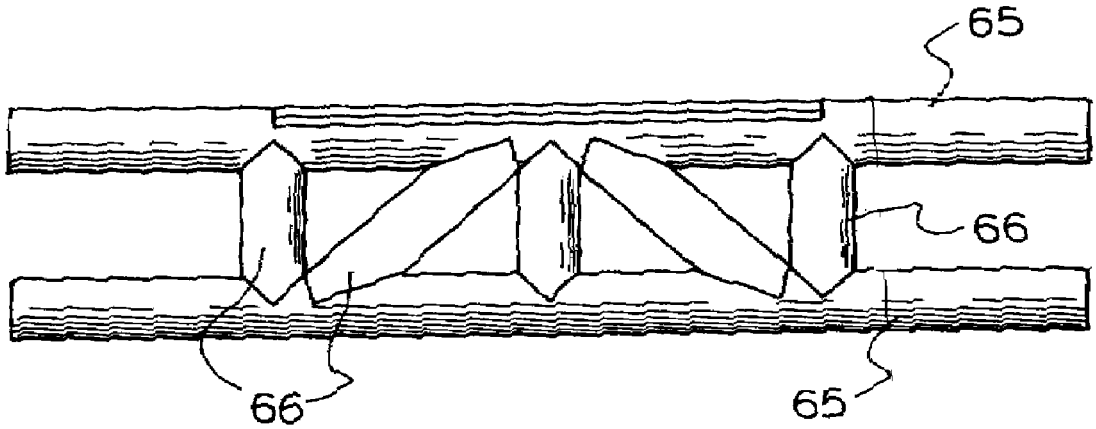

FIGS. 6*a*, 6*b* show connector components.

DETAILED DESCRIPTION OF PREFERRED EMBODIMENTS

Referring to the drawings it will be appreciated that the invention may be implemented in many forms for a range of boat sizes and shapes. The embodiments described here are given by way of example only.

FIG. 1 shows an assembled boat lift formed by four modules 10 each having the same or similar components. Each module has an upper pontoon 11 and a lower pontoon 12 connected by struts 13 through which air and/or water can flow. The pontoons and struts are preferably formed of a plastic material and these components are preferably moulded together as an integral structure. The upper pontoons have a flat top surface 14 forming a walkway but otherwise may have a variety of cross sectional shapes, preferably elongate with flat ends. The lower pontoons are generally larger than the upper pontoons and may also take a variety of elongate cross sectional shapes. The struts may also be varied in many ways, shown here in pairs that diverge upwards from the lower pontoon. Air is pumped into and released out of the modules through respective ports 15.

Each side of the lift in FIG. 1 is formed by coupling two modules together in-line using end connectors 16 and coupling opposing sides in parallel with side connectors 17. The end connectors may be provided in various forms such as the "dogbone" devices shown in FIG. 6*a*, while the side connectors may also take a range of structures. In this example, each side connector is provided as a pair of rods attached at each end to the lower pontoons. An alternative side connector is shown as a reinforced truss in FIG. 6*b*. The boat lift will also typically include a range of external features for assistance of users, including hull contacts, one or more hand rails and tie bars. The upper pontoons will also typically contain portions of a solid flotation material such as polystryrene to provide a minimum flotation level.

Figure 2:
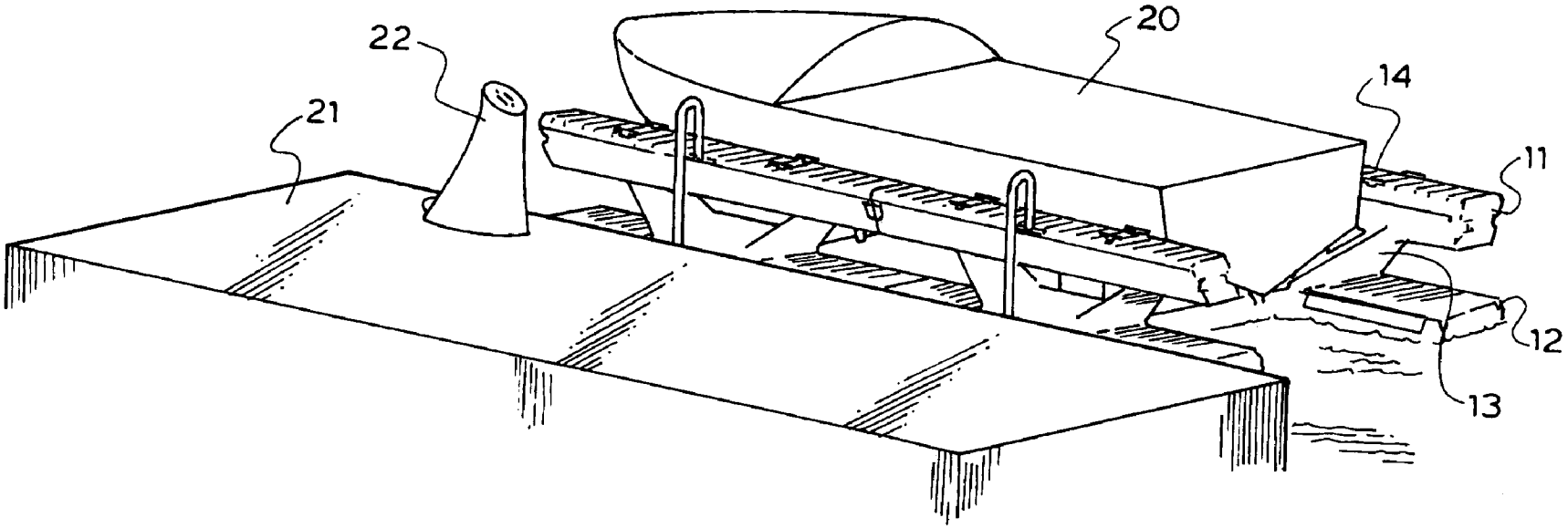
FIG. 2 shows the lift in action carrying a boat.

FIGS. 2 and 3 indicate operation of the boat lift in FIG. 1, carrying a boat 20 alongside a mooring deck 21. In FIG. 2 the lift is operated from a user station 22 mounted on the deck, which typically includes an electronic controller and air pump system. A number of pneumatic cables and valves pass from the station to the lift to blow air into the pontoons but these have been omitted for clarity. A series of inclinometers are preferably provided on the lift to provide signals for the controller. The lift can then be automatically operated so that the bow of the boat is held slightly higher than the stem for stability, preferably with range of parameters including a range of angles 4–7 degrees from horizontal. FIG. 3 outlines operation of software in the controller to increase or decrease buoyancy of the lift, once activated by a user, and is generally self explanatory.

FIGS. 4*a, b, c* give closer views one of the modules in FIG. 1 showing various external details. Indents 40 are provided in pairs at the ends of both the upper and lower pontoons 11, 12 for the end connectors 16. Ports 41 are provided in the lower pontoon with apertures for the side connectors 17. The lower pontoon has a generally curved lower surface 44. In this example, the module is positioned towards the front of the lift and carries the bow of the boat. Optional hull contacts 42 have therefore been shown in the lower pontoon. Tie bars 43 are also shown on the walkway 14.

Figure 5B:
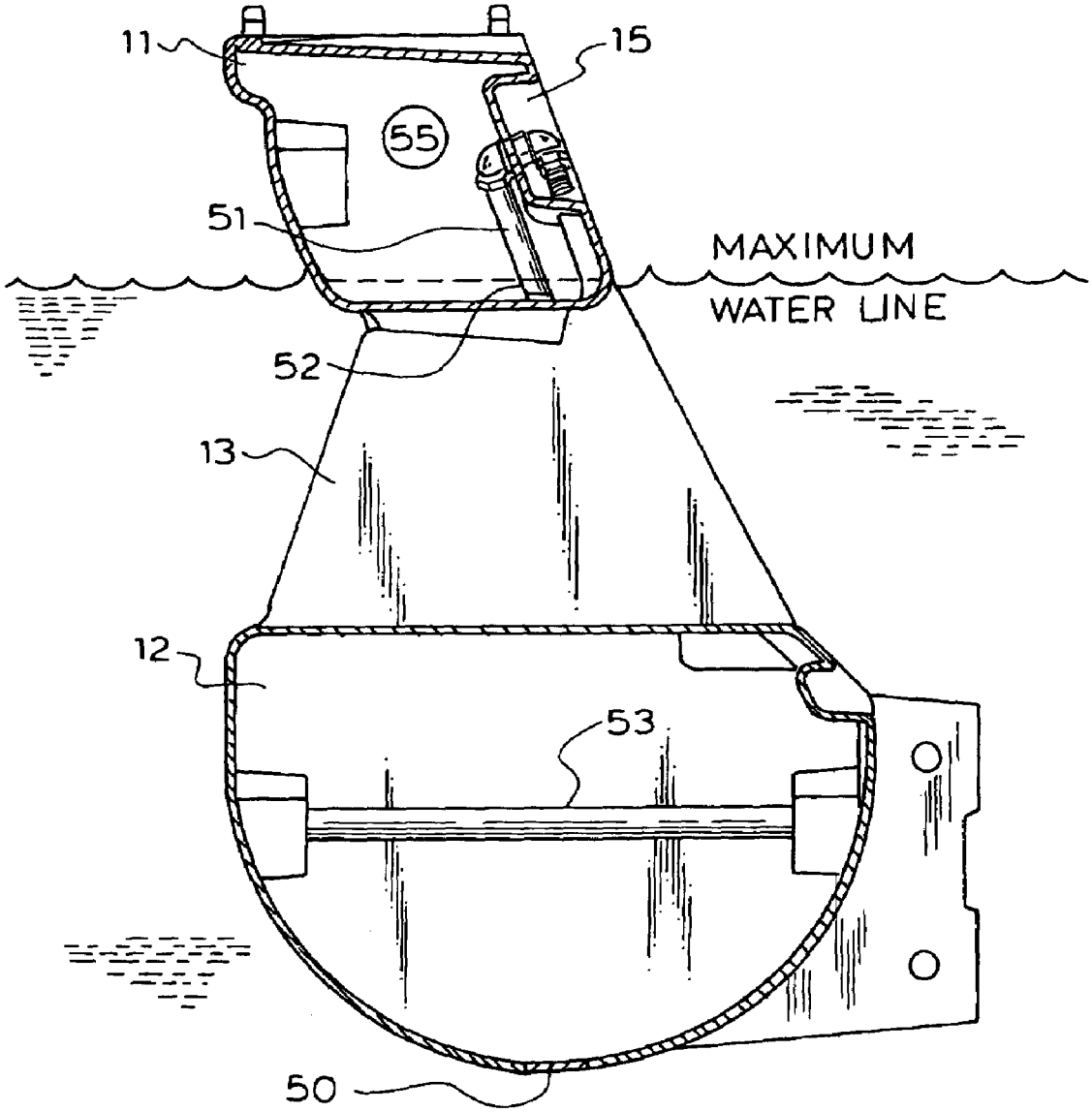
Figure 5C:
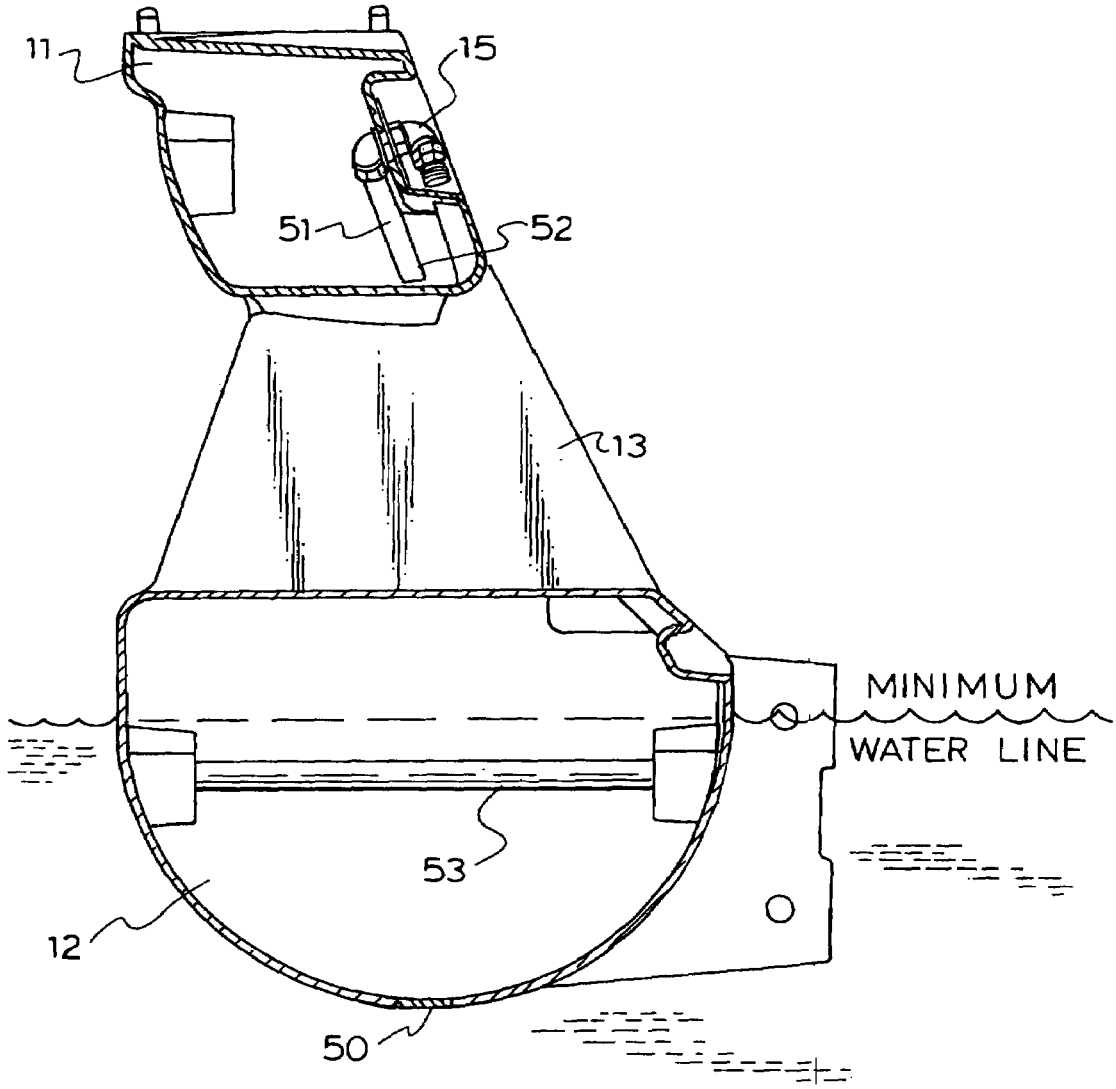
Figure 5D:
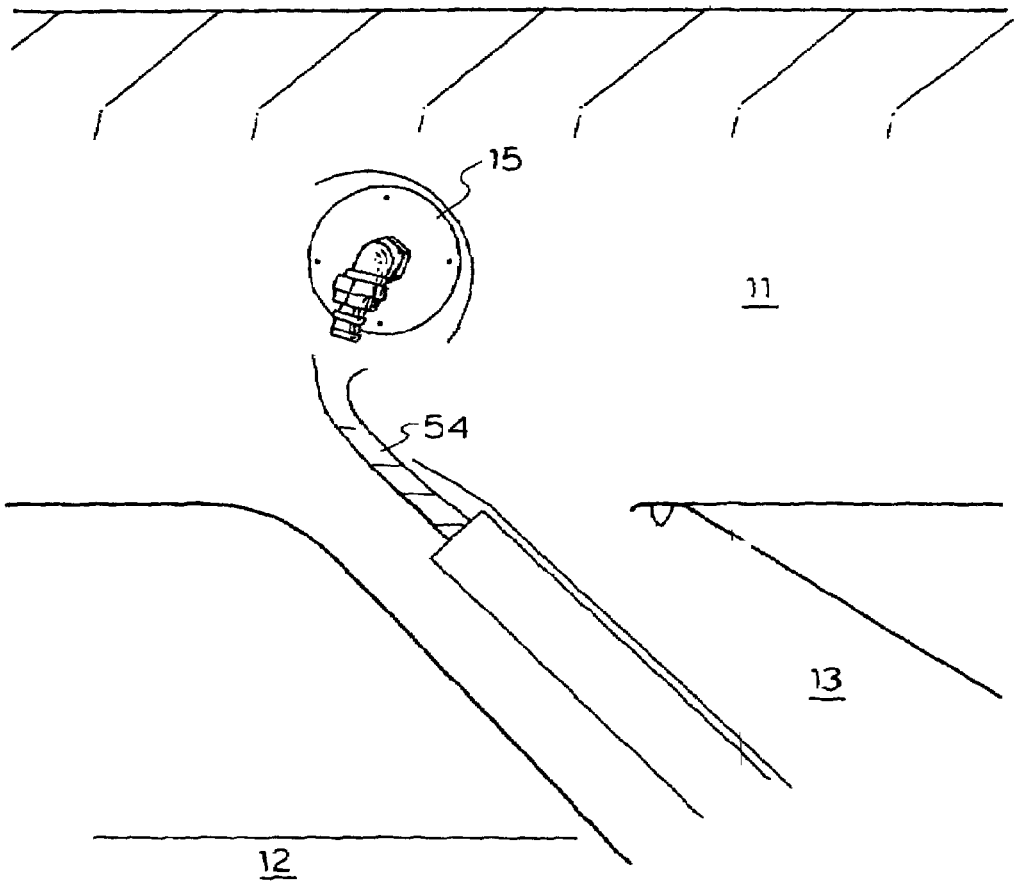

FIGS. 5*a–d* show aspects of an air pump system that may be provided in the boat lift of FIG. 1. In FIG. 5*a*, the lower surfaces of the lower pontoons 12 are shown in relation to boat 20. Each lower pontoon has an open port 50 for entry or exit of water as motion of the lift is controlled downwards or upwards respectively, when receiving or releasing the boat. In FIGS. 5*b* and 5*c*, cross-sections of the upper and lower pontoons are shown in relation to maximum and minimum levels of the water line. The upper pontoon may include a pipe 51 oriented downwards within the pontoon from port 15, for entry and exit of air as motion of the lift is controlled upwards or downwards respectively. The end 52 of the pipe determines the maximum water line and minimum buoyancy for downwards motion. A brace 53 may be provided in the lower pontoon. FIG. 5*d* gives an external view of the inlet 15 and indicates the passage of a pneumatic cable 54 to the air pump on deck 21.

In relation to FIGS. 5*a–d*, the buoyancy of the lift may be controlled in a simple fashion. To raise the lift under a boat, air is pumped into each module through port 15 by the pneumatic system, while water exits through port 50. The minimum water line and maximum buoyancy is determined by stopping the pump after a predetermined time and thereby stopping the upward motion. The pump may run until all modules exhaust air bubbles from port 50, showing maximum height has been achieved. Alternatively the controller may detect the height of the lift or some other suitable parameter.

There are two options to lock the lift in a raised position. Firstly, manual or automatic valves may close over ports 50, trapping the air inside the pontoons. A second option is to use a flexible pipe at each port 50, connected at one end to the port but weighted at the free end and connected with a draw line to the upper pontoon. The free ends of the pipes can be raised manually to the waterline using the draw lines and fixed in place using tie bars 43.

To lower the lift, valves in the pneumatic system are opened at the station 22 and air is released from each module through port 15, while water enters through port 50. The valves need not be closed at a predetermined point to stop the downward motion, because air inside each module can no longer exit once the water level inside the module has reached end 52 of the pipe 51. The air contained by volume 55 in the upper pontoon is trapped and determines the minimum buoyancy of the module. The pipes are sized and oriented similarly in each module.

FIGS. 6*a* and 6*b* show preferred end connectors 16 and side connectors 17 for the modules as indicated in FIG. 1. In FIG. 6*a*, the end connectors are provided as pairs of "dogbone" devices 60 to be held in place on opposite sides of a pontoon by way of a bolt 61. When assembling a boat lift from modules, a dogbone is installed across the indents 40 on either side of the join between in-line pontoons. The bolt is then tightened through the join between adjacent pontoons drawing the dogbones firmly into the indents. Preferably both the upper and lower pontoons are joined in this way. In FIG. 6*b*, the side connectors are provided as a pair of parallel tubes 65 braced by a number of trusses 66.

When assembling a boat lift, a pair of connectors are installed between opposing modules with the ends of the pipes 65 being bolted into in ports 41. Only the lower pontoons are normally joined in this way. Fittings shaped to support the hull of the boat may be fastened to the side connectors where required.

It will be appreciated that boat lifts and modules according to the invention can provide a number of advantages. In modular form, the lift can be provided as a kit, and can be altered to suit the length and beam of a particular vessel. The construction is simple in that the modules may be moulded as integral units, and the lifting action may be controlled by a natural mechanism.

The invention claimed is:

1. A module for a boat lift, including:

a lower pontoon having a port for entry and exit of water when decreasing or increasing buoyancy of the boat lift, an upper pontoon connected to the lower pontoon and having a port for entry or exit of air when increasing or decreasing buoyancy of the boat lift, end coupling means for coupling in-line to a further module when forming a common side of the lift, and side coupling means for coupling in parallel to a further module when forming opposing sides of the lift.

2. A module according to claim 1 wherein the port in the upper pontoon includes a pipe inside the unit and extending downwards toward the lower pontoon with the end of the pipe determining the maximum water line.

3. A module according to claim 1 wherein the port in the lower pontoon includes a pipe outside the unit and having a free end which can be raised or lowered in relation to the waterline.

4. A module according to claim 1 wherein the lower and upper pontoons are elongate chambers connected together for passage of air and water by a pair of struts.

5. A module according to claim 1 wherein the end coupling means includes at least one aperture to receive a connector device at the end of each pontoon.

6. A module according to claim 1 wherein the side coupling means includes at least one aperture to receive a connector device in the side of the lower pontoon.

7. A module according to claim 1 wherein the upper pontoon includes an upper surface forming a walkway.

8. A boat lift assembled from four or more modules as defined in claim 1, including connector devices between adjacent end coupling means, and connector devices between opposed side coupling means.

9. A boat lift according to claim 7 including a pneumatic control system and one or more inclinometers by which the orientation of the lift may be stabilised.

10. A boat lift according to claim 9 wherein the system enables the orientation to be controlled during raising and lowering of a boat in the water so that the stem of the boat is lower than the bow.

* * * * *